US007937797B2

(12) United States Patent
Tsuchiya et al.

(10) Patent No.: US 7,937,797 B2
(45) Date of Patent: May 10, 2011

(54) CLEANING ELEMENT AND CLEANING TOOL

(75) Inventors: Akemi Tsuchiya, Kanonji (JP); Yoshinori Tanaka, Kanonji (JP); Nicola John Policicchio, Mason, OH (US); Andrea Pfarr Switzer, Maineville, OH (US)

(73) Assignee: Uni-Charm Corporation, Ehime (JP)

( * ) Notice: Subject to any disclaimer, the term of this patent is extended or adjusted under 35 U.S.C. 154(b) by 649 days.

(21) Appl. No.: 12/058,233

(22) Filed: Mar. 28, 2008

(65) Prior Publication Data

US 2008/0235891 A1 Oct. 2, 2008

(30) Foreign Application Priority Data

Mar. 30, 2007 (JP) ..... 2007-095424

(51) Int. Cl.

| | |
|---|---|
| ***A47L 13/10*** | (2006.01) |
| ***A47L 13/16*** | (2006.01) |
| ***A47L 13/38*** | (2006.01) |
| ***A47L 13/20*** | (2006.01) |

(52) U.S. Cl. ..... 15/229.3; 15/209.1; 15/226; 15/229.4

(58) Field of Classification Search ..... 15/208, 15/209.1, 226, 229.3, 229.4, 229.7, 229.8
See application file for complete search history.

(56) References Cited

U.S. PATENT DOCUMENTS

| | | | | |
|---|---|---|---|---|
| 6,813,801 | B2 | 11/2004 | Tanaka et al. | |
| 2004/0016074 | A1 | 1/2004 | Tanaka | |
| 2004/0034956 | A1 * | 2/2004 | Tanaka et al. | 15/229.4 |
| 2005/0005381 | A1 | 1/2005 | Tanaka et al. | |
| 2006/0101602 | A1 | 5/2006 | Lin et al. | |

FOREIGN PATENT DOCUMENTS

| | | | |
|---|---|---|---|
| JP | 9-154791 | A | 6/1997 |
| JP | 2003265391 | A | 9/2003 |
| JP | 2006034990 | A | 2/2006 |
| WO | 2006070502 | A1 | 7/2006 |

* cited by examiner

*Primary Examiner* — Mark Spisich
(74) *Attorney, Agent, or Firm* — Lowe, Hauptman, Ham & Berner, LLP

(57) ABSTRACT

It is an object of the present invention to provide effective technique for a higher cleaning effect and higher operability of a cleaning element. Representative cleaning tool includes a cleaning element 110, the cleaning element 110 is provided with a fusion bonded part 114 having a curved portion 114*a* concaved to the holding space 118.

5 Claims, 9 Drawing Sheets

CLEANING ELEMENT AND CLEANING TOOL

RELATED APPLICATIONS

The present application is based on, and claims priority from, Japan Application Number 2007-095424, filed Mar. 30, 2007, the disclosure of which is hereby incorporated by reference herein in its entirety.

BACKGROUND OF THE INVENTION

1. Field of the Invention

The present invention relates to a cleaning tool and more particularly, to a cleaning tool having a cleaning element for wiping a region to be cleaned.

2. Description of the Related Art

Various types of cleaning tools having a sheet-type cleaning element for wiping an object are known. For example, Japanese non-examined laid-open Patent Publication No. 9-154791 discloses a cleaning tool having cleaning fabric and a holder that detachably holds the cleaning fabric inserted into a holding region of the cleaning fabric. This cleaning tool is capable of wiping a face to be cleaned by using the cleaning fabric held via the holder. However, in designing a cleaning element and cleaning tool, it is required to simplify the structure of holding the cleaning element to be attached to a cleaning element holder or other similar attachment.

SUMMARY OF THE INVENTION

Accordingly, it is an object of the invention to provide an effective technique for simplifying the structure of holding a sheet-type cleaning element for wiping an object to be cleaned.

The above-described problem can be solved by the features of the claimed invention. A representative cleaning element according to this invention includes at least a base sheet, a holding sheet, a first group and a second group of a plurality of fusion bonded parts, and a holding space. The cleaning element may be of disposable type designed for single use, disposable type designed for multiple use which can be used several times, while retaining dust which has been removed from the face to be cleaned, on a brush portion, or reusable type which can be reused by washing. The base sheet and the holding sheet are both formed of sheet-type nonwoven fabric.

The "nonwoven fabric" in this invention has a sheet-like configuration formed by fixing or entangling fibers by mechanical, chemical or heat treatment. Typically, the nonwoven fabric partly includes thermal melting fibers (thermoplastic fibers) and thus can be fusion bonded. In addition to the base sheet and the holding sheet, a further sheet element and/or fiber assembly may be provided.

The first group and the second group of the plurality of the fusion bonded parts are discontinuously formed along a predetermined direction to fusion bond the base sheet and the holding sheet overlaid one on the other. It is essential for the first group and the second group of the fusion bonded parts to be arranged discontinuously along a predetermined direction. Therefore, the configuration of these fusion bonded parts widely includes both a configuration having a plurality of bonded portions aligned on the same straight or curved line, and a configuration having a plurality of bonded portions not aligned on the same straight or curved line. Preferably, the first group of the plurality of the fusion bonded parts are arranged parallel to the second group of the plurality of the fusion bonded parts.

The holding space is demarcated by the first group of the plurality of the fusion bonded parts and the second group of the plurality of the fusion bonded parts between the base sheet and the holding sheet. The holding space has an open end at least on either one end or the other end of the cleaning element in the predetermined direction. The holding space is used as a region into which an attachment for holding the cleaning element is inserted.

In this construction, at least one of the first group and the second group of the fusion bonded parts includes a fusion bonded part having a concave portion facing the holding space, and the concave portion can engage with an attachment that is inserted into the holding space.

With such a construction of the cleaning element according to this invention, when the attachment is inserted into the holding space, the concave portion formed in the fusion bonded part can be used as an engagement region for engaging with the attachment. Therefore, in addition to its inherent function of fusion bonding the base sheet and the holding sheet to each other, the fusion bonded part is provided with a further function of engaging with the attachment. Thus, the structure of holding the cleaning element by the attachment can be simplified.

Further, the concave portion of the fusion bonded part may be curved or stepped. Typically, it may preferably have a curved surface shape comprising a circular arc portion of a circle or an ellipse in part or in entirety. With such a construction, sliding resistance caused between the attachment and the concave portion can be reduced, so that the attachment can be smoothly inserted into the holding space. Further, the "attachment" here typically includes a cleaning element holder which is inserted into the holding space in order to hold the cleaning element, and a user's finger.

Further, in the above-described construction, preferably, the cleaning element according to a further embodiment of this invention further includes a fiber assembly and a second fusion bonded part.

The fiber assembly has a plurality of fibers and is overlaid on the side of the base sheet opposite the holding sheet. Preferably, the fiber assembly has a planar structure having a predetermined flat or curved face and has a three-dimensional form having a certain thickness or has a thin sheet-like form. The "fibers" herein are elements of yarn, textile or the like and defined as being thin and flexible fibers having a substantially longer length compared with the thickness. Typically, a long continuous fiber is defined as a filament and a short fiber as a staple. The "fiber assembly" here is a single fiber structure formed by the above-mentioned fibers, a fiber structure having the above-mentioned fibers aligned in the length direction and/or the radial direction (twist yarn, spun yarn, yarn to which a plurality of filaments are partially connected), or an assembly of the fiber structures. Typically, the fiber assembly is formed of polyethylene (PE), polypropylene (PP), polyethylene terephthalate (PET), nylon, rayon or the like. In practical use, an assembly of filaments formed by opening a tow is frequently used as the fiber assembly.

The second fusion bonded part is provided between the first group of the plurality of the fusion bonded parts and the second group of the plurality of the fusion bonded parts and extend in the predetermined direction so as to fusion bond at least the base sheet and the fiber assembly. The second fusion bonded part demarcates the holding space into two space portions. The two space portions formed by demarcating the holding space are arranged side by side in a predetermined direction. It is essential for the second fusion bonded part to extend in the predetermined direction. Therefore, the configuration of the second fusion bonded part widely includes a configuration in which a bonded portion continuously linearly extend and a configuration in which a bonded portion discontinuously extend. Further, the second fusion bonded part may be designed to further fusion bond the holding sheet in addition to the base sheet and the fiber assembly.

Such a construction is effective for the attachment of which portion to be inserted into the holding space is at least bifurcated. In this case, the balance of holding the cleaning element by the attachment can be stabilized.

Further, in the cleaning element according to a further embodiment of this invention, preferably, the first group and the second group of the plurality of the fusion bonded parts and the second fusion bonded part fusion bond the base sheet and the fiber assembly to each other.

Such a construction is effective in forming a horizontal section having a relatively high bond strength between the second fusion bonded part and the first group and the second group of the plurality of the fusion bonded parts by joining the fiber assembly and the base sheet. Further, with this construction having the horizontal section, the cleaning element can easily conform to a horizontal face to be cleaned, during cleaning operation. Thus, this construction is effective in enhancing the cleaning effect.

Further, in the cleaning element according to a further embodiment of this invention, preferably, the holding space is provided as a region into which a cleaning element holding portion of the attachment in the form of a holder to be held by a user is inserted, so that the cleaning element holding portion engages with the concave portion in the inserted state and thereby holds the cleaning element.

With such a construction, in using the cleaning tool for cleaning operation, the cleaning element holding portion of the holder can be inserted into the holding space.

A cleaning element according to this invention includes the above-described cleaning element and a cleaning element holder. The cleaning element holder is removably attached to the cleaning element. The cleaning element holder includes a grip to be held by a user in a cleaning operation, a cleaning element holding portion that is coupled to the grip, extends elongate and is inserted into the holding space of the cleaning element, thereby holding the cleaning element, and a projection that projects outward from the cleaning element holding portion. In this construction, when the cleaning element holding portion is inserted into the holding space, the projection of the cleaning element holding portion engages with a concave portion of the cleaning element such that the cleaning element holding portion is prevented from moving with respect to the cleaning element in a predetermined direction. In the state in which the cleaning element holder is attached to the cleaning element, the cleaning element is held by the cleaning element holding portion of the cleaning element holder and the cleaning operation is performed while the user holds the grip of the cleaning element holder. Further, the user can remove the cleaning element from the cleaning element holding portion of the cleaning element holder and replace it with a new one as necessary.

With such a construction of the cleaning tool according to this invention, once the cleaning element holding portion is inserted into the holding space, the concave portion of the cleaning element prevents movement of the projection of the cleaning element holding portion. Thus, such a construction is effective for preventing disengagement between the cleaning element and the cleaning element holding portion.

As described above, according to this invention, in a sheet-type cleaning element for wiping a region to be cleaned, particularly by provision of an improved construction of the fusion bonded parts for fusion bonding the base sheet and the holding sheet which form the cleaning element, the structure of holding the cleaning element by the attachment can be simplified. Other objects, features and advantages of the present invention will be readily understood after reading the following detailed description together with the accompanying drawings and the claims.

DETAILED DESCRIPTION OF THE INVENTION

Each of the additional features and method steps disclosed above and below may be utilized separately or in conjunction with other features and method steps to provide and manufacture improved cleaning elements and method for using such cleaning elements and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

A representative embodiment of the present invention will now be described with reference to the drawings. First, the structure of a cleaning tool 100 according to this embodiment is explained with reference to FIGS. 1 to 6. Objects to be cleaned with the cleaning tool 100 includes regions to be cleaned (floors, walls, windows, ceilings, external walls, furniture, clothes, curtains, bedding, lighting, home electric appliances, etc.) inside and outside of houses, apartments, buildings, factories, vehicles, etc. and regions of human body parts to be cleaned. These regions to be cleaned may be either flat or curved, uneven or stepped.

Figure 1:
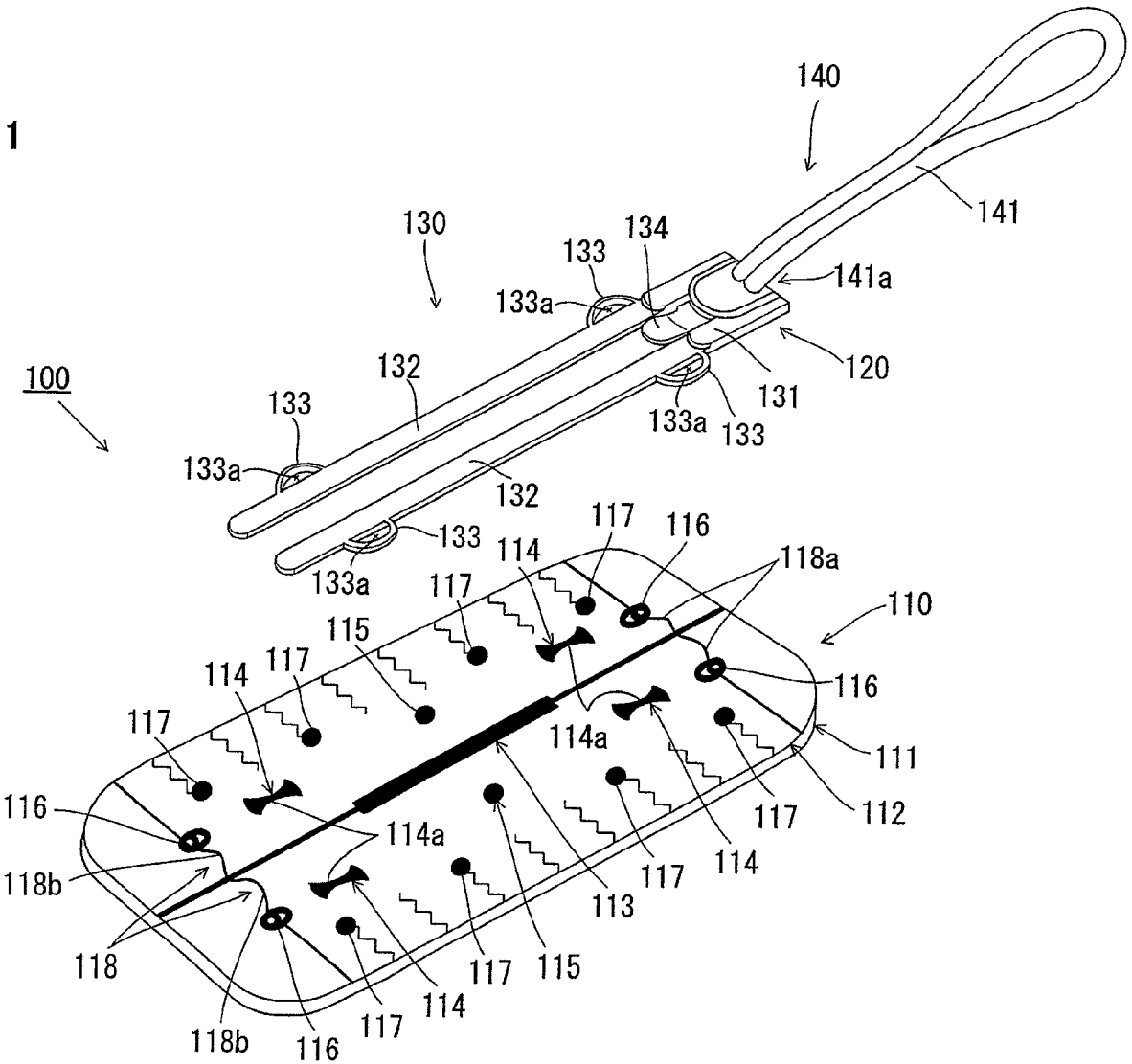
FIG. 1 is a perspective view showing a cleaning tool 100 according to an embodiment of the present invention, in a disassembled state into a cleaning element 110 and a cleaning element holder 120.

FIG. 1 shows the cleaning tool 100 according to this embodiment in perspective view, in a state disassembled into a cleaning element 110 and a cleaning element holder 120. As shown, the cleaning tool 100 comprises the cleaning element 110 and the cleaning element holder 120.

The cleaning element 110 includes a cleaning element body 111 and a holding sheet 112 overlaid on and joined to the upper face of the cleaning element body 111. The cleaning element 110 has a function of removing dirt on the regions to be cleaned. The cleaning element 110 is available in a sheet-like form, and in use, it is loosened such that its volume is increased. As shown in FIG. 1, the cleaning element 110 is rectangular in plan view and elongate in a predetermined longitudinal direction (the direction of the length). This predetermined longitudinal direction generally corresponds to the direction crossing the direction in which the plurality of fibers forming the fiber assembly extend. The cleaning element 110 is a feature that corresponds to the "cleaning element" according to this invention.

The cleaning element 110 may also be formed into a square shape in plan view as necessary. The cleaning element 110 may be of disposable type designed for single use, disposable type designed for multiple use which can be used several times, while retaining dust which has been removed from the face to be cleaned, on the brush portion, or reusable type which can be reused by washing.

The cleaning element body 111 and the holding sheet 112 which form the cleaning element 110 are fusion bonded together in part or in entirety at a central joining line 113 extending in a continuous straight line in the middle of the cleaning element 110 in its longitudinal direction and at a plurality of fusion bonded parts 114, 115, 116, 117 disposed on the both sides of the central joining line 113.

Thus, a holding space extending in the longitudinal direction of the cleaning element 110 are defined between the left fusion bonded parts 114, 115 and the right fusion bonded parts 114, 115. This holding space is partitioned into a pair of right and left holding spaces 118 by the central joining line 113. The holding spaces 118 here are features that correspond to the "holding space" according to this invention. Each of the holding spaces 118 has a rear open end 118*a* (on the right as viewed in FIG. 1) and a front open end 118*b* (on the left as viewed in FIG. 1). Holding portions of a cleaning element holder 120 which is described below (holding plates 132 of a holder body 130 which is described below) can be inserted into the holding spaces 118 from both the rear open end 118*a* and the front open end 118*b*. The holding spaces 118 are shaped to have adequate size (insertion width and insertion depth) to receive the holding plates 132 of the holder body 130. In this embodiment, the pair of right and left holding spaces 118 are arranged side by side in the lateral direction, so that the balance of holding the cleaning element 110 by the holding plates 132 can be stabilized. Further, at least either one of the rear open end 118*a* and the front open end 118*b* of each of the holding spaces 118 may be closed. Further, a holding space into which a user's finger can be directly inserted may be used in place of the holding spaces 118.

The cleaning element 110 having the above-described structure is removably attached to the cleaning element holder 120. The cleaning element holder 120 is an elongate member including the holder body 130 and the handle 140 connected to each other. The cleaning element holder 120 is a feature that corresponds to the "cleaning element holder" or the "holder to be held by a user" according to this invention. The handle 140 includes a longitudinally extending handle body 141 and a connection 141*a* disposed between the handle body 141 and the holder body 130. The handle body 141 is held by a user and is a feature that corresponds to the "grip" in this invention. The handle body 141 and the holder body 130 are fixedly connected at the connection 141*a*.

The holder body 130 has a function of detachably holding the cleaning element 110 and is a feature that corresponds to the "cleaning element holding portion" in this invention. The holder body 130 includes a pair of right and left holding plates 132 and a retaining plate 134 which are formed on a base 131 on the handle 140. The holding plates 132 extend forward in the longitudinal direction from the base 131 and parallel with a predetermined spacing therebetween. In other words, the holder body 130 has a bifurcated form. Each of the holding plates 132 has a constant width in the longitudinal direction or is tapered. The holding plates 132 may also have a circular or polygonal section forming a rod-like shape.

Further, two projections 133 are formed on the front and rear portions of the outer edge of each of the holding plates 132. Each of the projections 133 has an elliptic contour projecting outward from the holding plate 132 and has a convexly curved projecting surface. For example, the projection 133 has an elliptic contour having a 180° circular arc angle, a 16 mm major axis and a 8 mm minor axis. Further, an opening or hollow portion 133*a* is formed in the central portion of the projection 133. The projection 133 is a feature that corresponds to the "projection that projects outward from the cleaning element holding portion" in this invention.

The retaining plate 134 extends forward between the pair holding plates 132 and is convexly curved downward. The retaining plate 134 further has an engagement lug (not shown) on the underside.

Each of the holding plates 132 can be inserted into the associated holding space 118 and has a function of holding the cleaning element 110 in the inserted state. In the inserted state, the holding plate 132 is fitted in the associated holding space 118 by close sliding contact, so that the cleaning element 110 is securely attached to the holding plate 132. Further, in the inserted state, the retaining plate 134 presses the cleaning element 110 from above, and the engagement lug (not shown) formed on the underside of the retaining plate 134 serves as a stopper for preventing the cleaning element 110 from coming off. Thus, in the inserted state in which the holding plate 132 is inserted into the holding space 118, the cleaning element 110 is reliably retained by the holder body 130.

Figure 2:
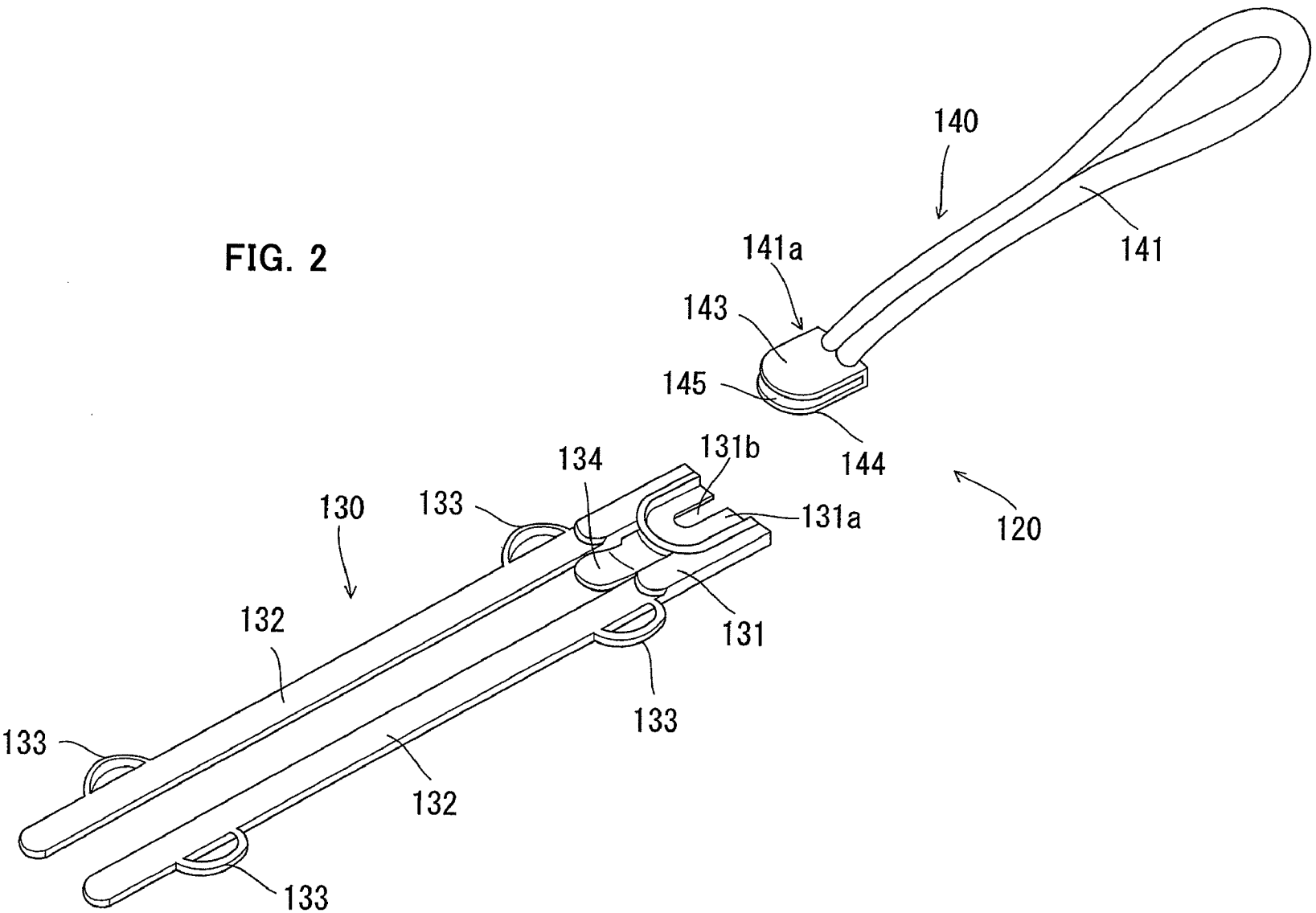
FIG. 2 is a perspective view of the cleaning element holder 120 of FIG. 1 in a disassembled state.

FIG. 2 is a perspective view of the cleaning element holder 120 of FIG. 1 in a disassembled state. As shown, the holder body 130 and the handle 140 are separately resin molded and thereafter disengageably connected together. With this construction, the weight of the entire cleaning tool can be reduced, and the manufacturing costs of the cleaning tool can also be reduced. Further, the cleaning element holder 120 may have other structures, such as a structure in which the holder body 130 and the handle 140 (the handle body 141 and the connection 141*a*) are integrally formed, a structure in which two of the holder body 130, the handle 140 and the connection 141*a* are integrally formed, and a structure in which the holder body 130 and the handle 140 are separately formed and designed to be fixedly connected together.

The holder body 130 has an engagement plate 131*a* on the rear end of the base 131. The handle 140 has a first engaging plate 143 and a second engaging plate 144 on the front end of the handle body 141. An engagement region 145 is defined between the first engaging plate 143 and the second engaging plate 144 and can receive the engagement plate 131*a*. A projection (not shown) is provided in the engagement region 145 and can be engaged with a recess 131*b* of the engagement plate 131*a*. Thus, when the engagement plate 131*a* is inserted into the engagement region 145, the engagement plate 131*a* is sandwiched between the first engaging plate 143 and the second engaging plate 144. Further, the projection of the engagement region 145 is engaged with the recess 131*b* of the engagement plate 131*a*. Thus, the holder body 130 and the handle 140 are joined together by a joining force acting therebetween. In this state, the holder body 130 and the handle 140 can be disengaged from each other by pulling the holder body 130 and the handle 140 apart from each other by a pulling force larger than the joining force.

Figure 3:
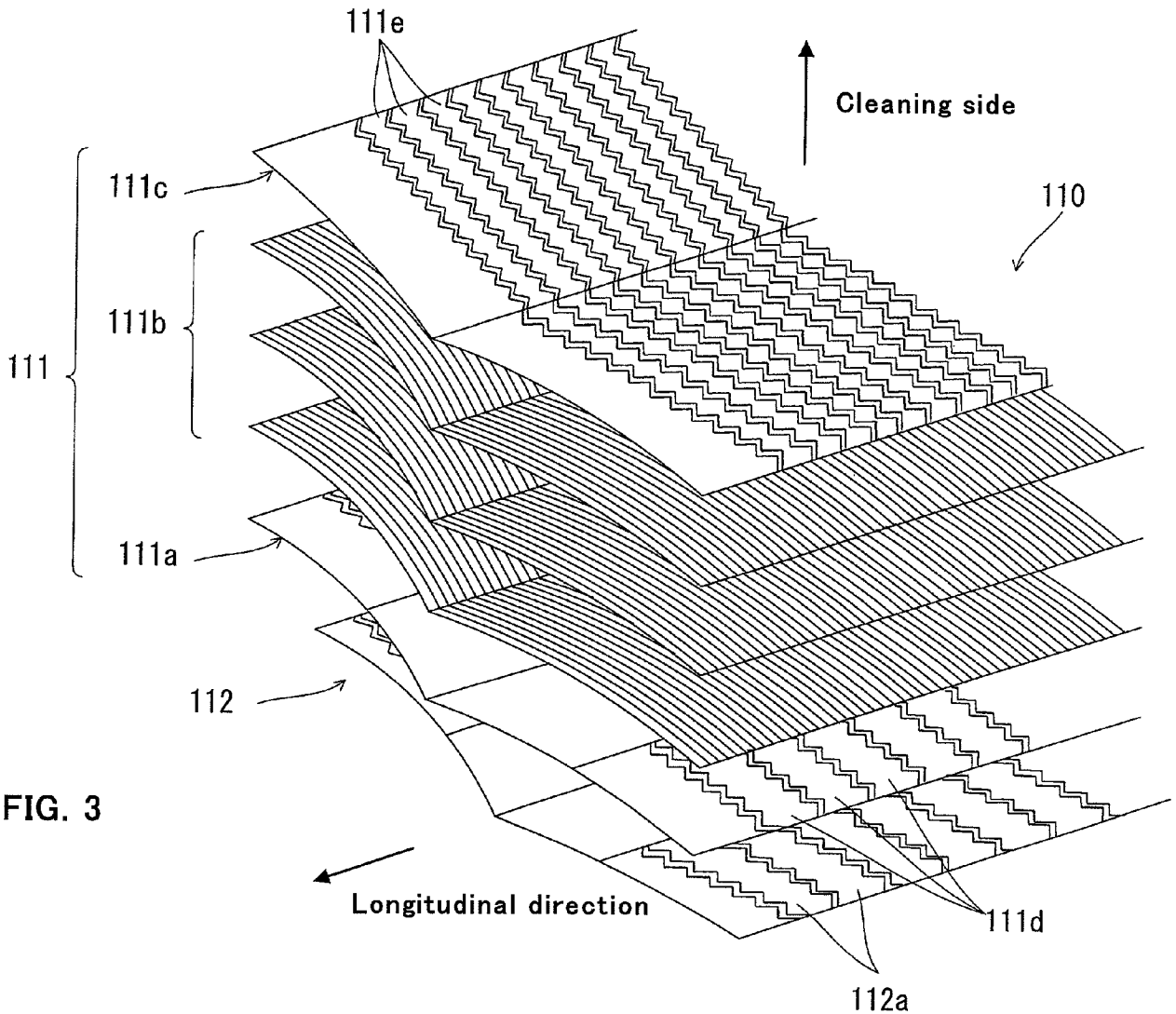
FIG. 3 is a perspective view of the cleaning element 110 of FIG. 1 which is shown separated into component elements.
Figure 4:
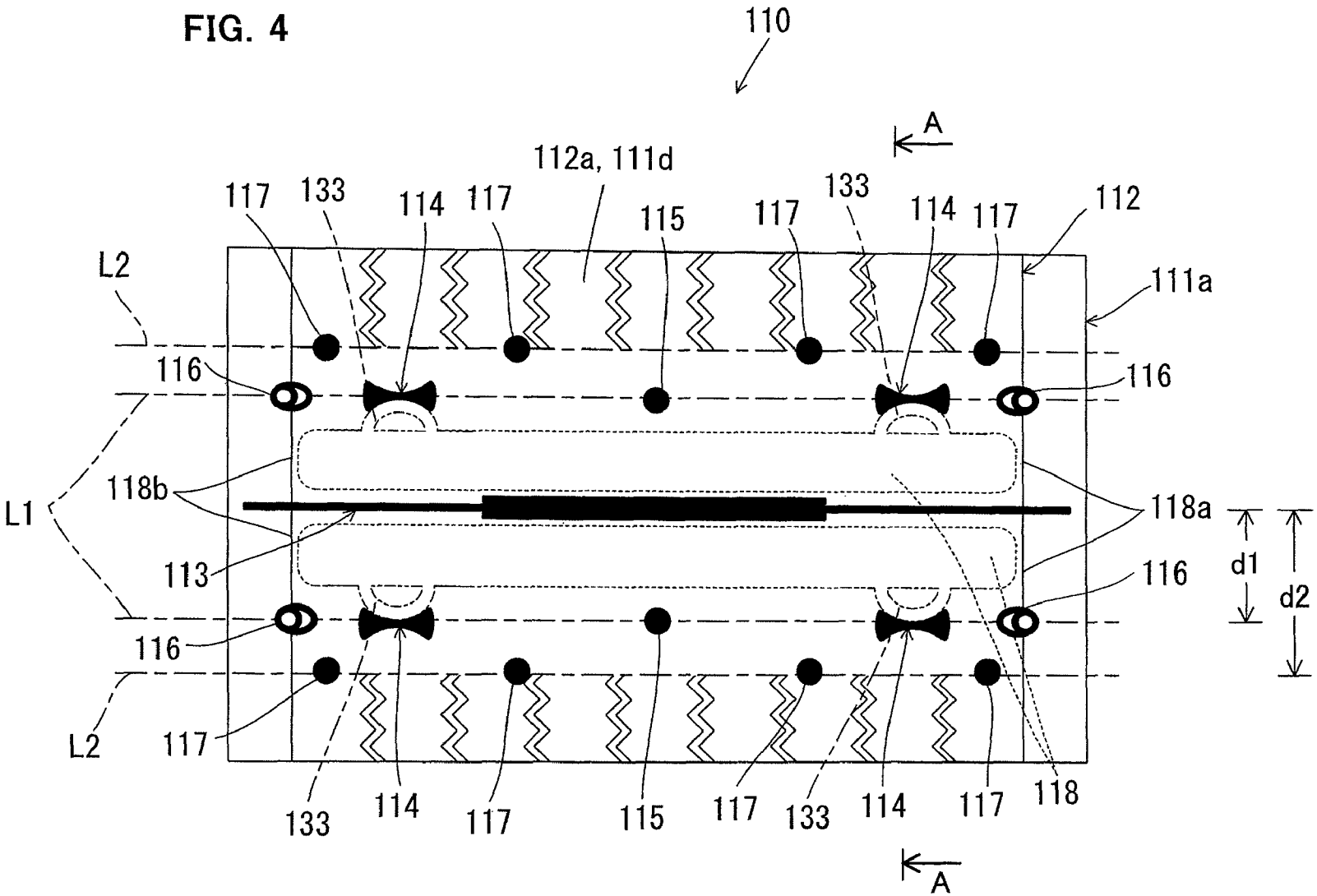
FIG. 4 is a plan view of the cleaning element 110 shown in FIG. 1, as viewed from the top of the cleaning element.
Figure 5:
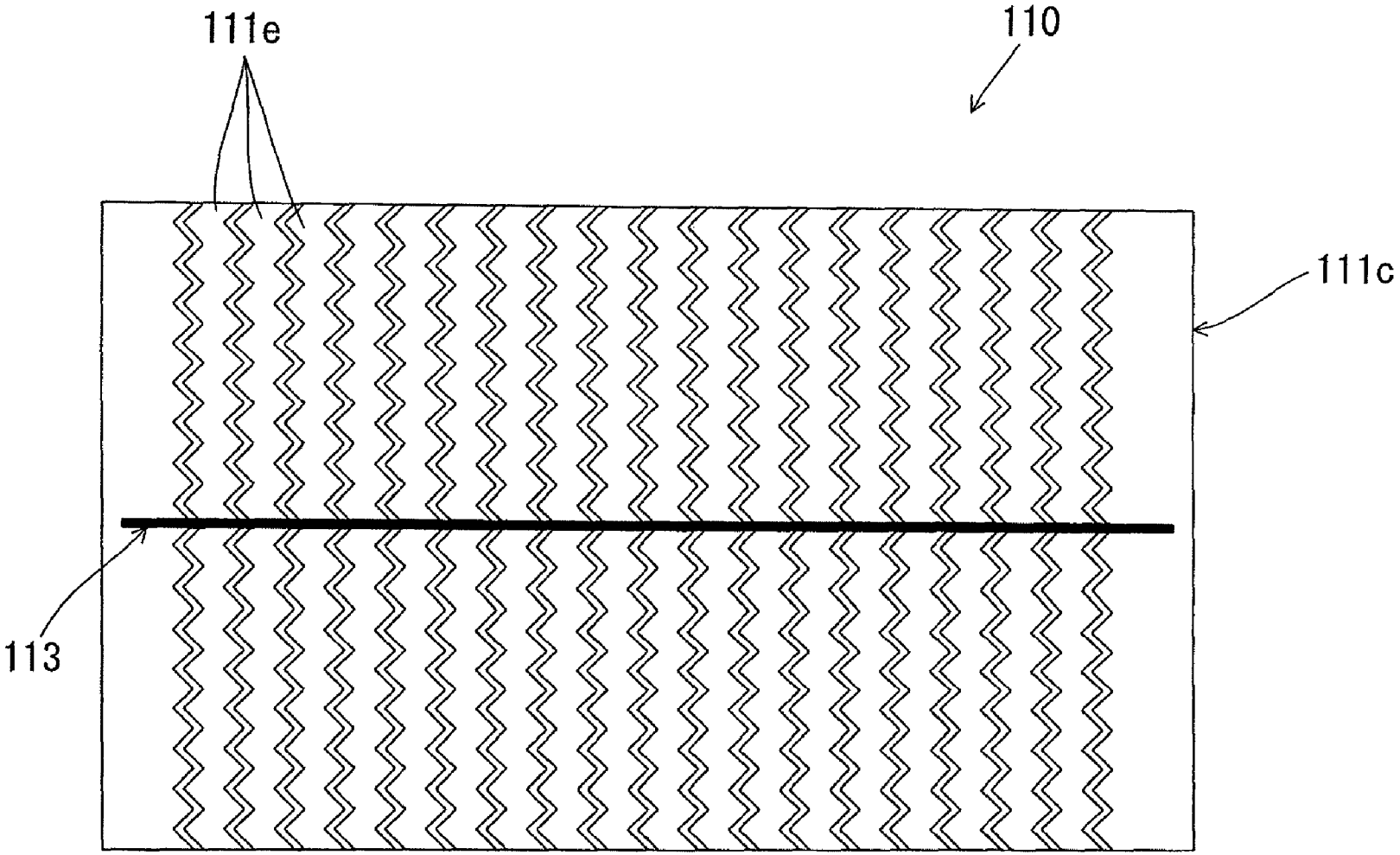
FIG. 5 is a plan view of the cleaning element 110 shown in FIG. 1, as viewed from the back of the cleaning element.
Figure 6:
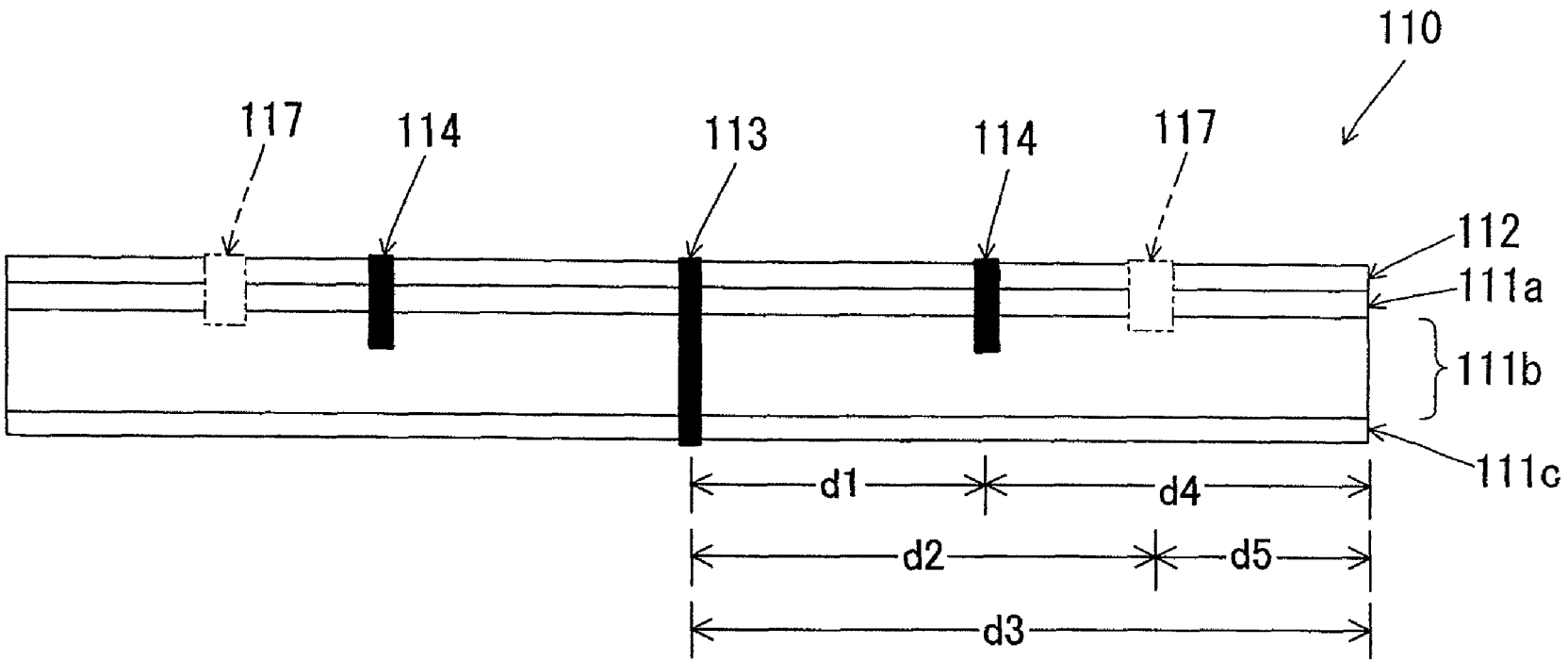
FIG. 6 is a sectional view of the cleaning element 110, taken along line A-A in FIG. 4.

Referring to FIGS. 3 to 6, the structure of the cleaning element 110 of this embodiment will be specifically described. FIG. 3 is a perspective view of the cleaning element 110 of FIG. 1 which is shown separated into component elements. FIG. 4 is a plan view of the cleaning element 110 shown in FIG. 1, as viewed from the top of the cleaning element. FIG. 5 is a plan view of the cleaning element 110 shown in FIG. 1, as viewed from the back of the cleaning element. FIG. 6 is a sectional view of the cleaning element 110, taken along line A-A in FIG. 4.

As shown in FIG. 3, in the cleaning element 110 of this embodiment, the holding sheet 112 is overlaid on the cleaning element body 111 on the cleaning side (which is also referred to as the "lower face side" or the "back"). Further, the cleaning element body 111 has the cleaning side sheet 111*c*, the fiber assembly 111*b* and the base sheet 111*a* overlaid one on the other in this order from the cleaning side (lower face side). In this case, the holding sheet 112 and the base sheet 111*a* are overlaid on the side of the fiber assembly 111*b* opposite the cleaning side sheet 111*c* (lower face side sheet) and forms an upper face side sheet. The base sheet 111*a*, the fiber assembly 111*b* and the cleaning side sheet 111*c* are similarly rectangular in plan view and all extend elongate in the longitudinal direction of the cleaning element 110. The fiber assembly 111*b* and the cleaning side sheet 111*c* form a brush-like part having a dirt removing function, which is also referred to as the "brush portion". Further, in this embodiment, the cleaning element body 111 of the cleaning element 110 is described as a structure having the base sheet 111*a*, the fiber assembly 111*b* and the cleaning side sheet 111*c* stacked in layer, but may be constructed as a structure having an additional fiber layer and/or sheet.

The holding sheet 112, the base sheet 111*a* and the cleaning side sheet 111*c* have a plurality of zigzag strips (strip portions) extending in a direction crossing the longitudinal direction of the cleaning element 110. Specifically, the holding sheet 112 comprises a plurality of strips 112*a* arranged in parallel and extending in a direction crossing the longitudinal direction of the cleaning element 110. The base sheet 111*a* comprises a plurality of strips 111*d* arranged in parallel and extending in a direction crossing the longitudinal direction of the cleaning element 110. The cleaning side sheet 111*c* comprises a plurality of strips 111*e* arranged in parallel and extending in a direction crossing the longitudinal direction of the cleaning element 110. An improved structure which can easily trap dust and thus has a higher cleaning function can be realized by the zigzag strips of the sheets. The strips may have the same kind or different kinds of shape appropriately selected from various shapes, such as zigzag, linear and curved shapes.

As shown in FIG. 4, in the base sheet 111*a*, the strips 111*d* extend outward from the fusion bonded parts 114, 115, 116, 117 formed in the longitudinal direction of the cleaning element 110. Further, in the holding sheet 112 overlaid on the upper face of the base sheet 111*a*, the strips 112*a* having the same shape as the strips 111*d* extend outward from the fusion bonded parts 114, 115, 116, 117 formed in the longitudinal direction of the cleaning element 110.

Further, as shown in FIG. 5, in the cleaning side sheet 111*c*, the strips 111*e* having a smaller width than the strips 111*d*, 112*a* extend outward from the central joining line 113 extending along the longitudinal direction of the cleaning element 110. Therefore, the proximal ends of the strips 111*e* are joined at the central joining line 113. Each of the strips 111*e* extends elongate from one end fixed at the central joining line 113 to the other free end (distal end) on the side opposite to the fixed end.

The construction of the nonwoven fabric forming the above-described base sheet 111*a*, cleaning side sheet 111*c* and holding sheet 112 and the construction of the fiber assembly 111*b* are now explained in detail.

The base sheet 111*a*, the cleaning side sheet 111*c* and the holding sheet 112 can typically be formed of sheet-type nonwoven fabric comprising thermal melting fibers (thermoplastic fibers) and thus referred to as nonwoven fabric sheet. The base sheet 111*a* and the holding sheet 112 herein are the features that correspond to the "base sheet" and the "holding sheet", respectively, according to this invention. The nonwoven fabric has a sheet-like configuration formed by fixing or entangling fibers by mechanical, chemical or heat treatment. The nonwoven fabric partly includes thermoplastic fibers and thus can be fusion bonded. Further, the nonwoven fabric has a plurality of strips. Examples of the thermal melting fibers (thermoplastic fibers) include polyethylene, polypropylene and polyethylene terephthalate. The nonwoven fabric may be manufactured by through-air bonding, spun bonding, thermal bonding, spun lacing, point bonding, melt blowing, stitch bonding, chemical bonding, needle punching or other similar processes. This nonwoven fabric is a feature that corresponds to the "nonwoven fabric" according to this invention. In order to enhance the dust wiping function, it is preferred to use a nonwoven fabric having higher rigidity. Further, as an alternative to or in addition to the nonwoven fabric, a material to be worked into strips, such as urethane, sponge, woven fabric, net and split cloth, may be used.

The fiber assembly 111*b* is a single fiber structure formed by fibers, a fiber structure having fibers aligned in the length direction and/or the radial direction (twist yarn, spun yarn, yarn to which a plurality of filaments are partially connected), or an assembly of the fiber structures. The fiber assembly 111*b* partially includes thermoplastic fibers and can be fusion bonded. The fibers forming the fiber assembly 111*b* are elements of yarn, textile or the like and defined as being thin and flexible fibers having a substantially longer length compared with the thickness. Typically, a long continuous fiber is defined as a filament and a short fiber as a staple. The proximal ends of the fibers of the fiber assembly 111*b* are joined at the central joining line 113 and the fusion bonded parts 114, 116. The fibers of the fiber assembly 111*b* each have one end fixed at the fusion bonded parts and the other free end (distal end) on the opposite side. The fibers of the fiber assembly 111*b* extend elongate in a direction crossing the longitudinal direction of the cleaning element 110 (or the fiber assembly 111*b*). The fiber assembly 111*b* extending in a direction crossing the longitudinal direction of the cleaning element 110 is a feature that corresponds to the "fiber assembly comprising a plurality of fibers" according to this embodiment. The fiber assembly 111*b* is also referred to as the "fiber bundle" having a plurality of fibers in a bundle.

In the representative example shown in FIG. 3, the fiber assembly 111*b* comprises three fiber layers, but it may comprise one or more fiber layers as necessary. Preferably, the fiber assembly 111*b* has a planar structure having a predetermined flat or curved region and has a three-dimensional form having a certain thickness or has a thin sheet-like form. The "fiber assembly" is typically formed of polyethylene (PE), polypropylene (PP), polyethylene terephthalate (PET), nylon, rayon or the like. In practical use, an assembly of filaments formed by opening a tow is frequently used as the fiber assembly. It is particularly preferable that the fiber assembly comprises conjugated fibers having a core of polypropylene (PP) or polyethylene (PE) and a core covering sheath of polyethylene (PE). Further, the filaments of the fiber assembly are preferred to have a fineness of 1 to 50 dtex, more preferably 2 to 10 dtex. The individual fiber assembly may contain fibers of generally the same fineness or of different finenesses.

Further, in order to enhance the dust wiping function, it is preferred to use a fiber assembly including fibers having higher rigidity or fibers having higher fineness. It is further preferred that the fiber assembly has crimped fibers. Here, the crimped fibers are fibers subjected to a predetermined crimping process and easily entangled with each other. With the fibers being crimped, the fiber assembly becomes bulkier than before the holder is attached thereto, and dust can be easily captured by the crimped portions. This structure can be realized especially by using crimped fibers opened from a tow.

For the fiber assembly, flat yarns or split yarns may also be employed. The flat yarns are prepared by slitting a film into tapes and by stretching the tapes in the longitudinal direction. The split yarns are prepared by splitting a thermoplastic film resin in the direction perpendicular to the orientation direction of the resin so that the film is fibrillated and interconnected into a net shape. Alternatively, a nonwoven fabric which is bulky and has low fiber density, such as a through-air bonded nonwoven fabric, may be employed to form the fiber assembly.

The kinds and numbers of the component parts of the cleaning element 110 are not limited to those described in the above-described example, and can be selected as necessary. The cleaning element 110 is rectangular in plan view and is attached to the cleaning element holder 120 such that its longer side extends along the longitudinal direction of the holder body 130 and a handle 140 of the cleaning element holder 120.

The construction of the fusion bonded parts in the cleaning element 110 is now explained in further detail with reference to FIGS. 4 and 6. As shown in FIG. 4, the central joining line 113 forms an elongate fusion bonded portion centrally formed in the cleaning element 110 and extending in the longitudinal direction of the cleaning element 110. The fusion bonded portion of the central joining line 113 may continuously linearly extend or discontinuously extend. The fusion bonded parts 114, 115, 116, 117 are formed on the both sides of the central joining line 113 and arranged along the extending direction of the central joining line 113. Specifically, on each of extending lines L1 on the both sides of the central joining line 113 with a spacing of a first distance d1 from the central joining line 113, the fusion bonded parts 116 are formed at the rear open end 118*a* and the front open end 118*b*, and two fusion bonded parts 114 are formed between the two fusion bonded parts 116. Further, one fusion bonded part 115 is formed between the two fusion bonded parts 114. Further, on each of extending lines L2 on the both sides of the central joining line 113 with a spacing of a second distance d2 (>first distance d1) from the central joining line 113, the fusion bonded parts 117 are formed. The extending lines L1, L2 may be either straight lines as shown in FIG. 4, or curved lines. The fusion bonded parts 114, 115, 116 form "a first group and a second group of a plurality of fusion bonded parts" and the central joining line 113 form "a second fusion bonded part" according to this invention.

The fusion bonded parts 116 are formed at the rear open end 118*a* and the front open end 118*b* and provide a function of guiding the holding plate 132 to be smoothly inserted into the holding space 118. Therefore, the fusion bonded parts 116 extend elongate in the extending direction of the holding space 118 and preferably includes a linear portion extending linearly toward the holding space 118. Each of the fusion bonded parts 116 has a fusion bonded portion shaped into a combined form of a circle (perfect circle) and an ellipse. In this manner, when the holding plate 132 of the holder body 130 is inserted into the holding space 118, the holding plate 132 can be more smoothly guided into the holding space 118. It is essential for the fusion bonded parts 116 to have at least an elongate portion. The shape and the number of the fusion bonded parts 116 can be changed as necessary.

Provision of the fusion bonded part 115 between the two fusion bonded parts 114 is effective for well-balanced arrangement of the fusion bonded parts on the extending line L1. The number of the fusion bonded parts 115 to be formed between the two fusion bonded parts 114 can be increased as necessary.

Each of the fusion bonded parts 114 has at least a concavely curved portion (circular arc portion) 114*a* facing the projection 133 of the inserted holding plate 132 which projects outward from the holding plate 132 of the holder body 130. The curved portion 114*a* is defined as a region for receiving the projection 133 of the holding plate 132 after insertion of the holding plate 132 into the holding space 118. The curved portion 114*a* here is a feature that corresponds to the "concave portion", and the fusion bonded part 114 having the curved portion 114*a* is a feature that corresponds to the "fusion bonded part having a concave portion" according to this invention. Thus, the projection 133 of the holding plate 132 inserted into the associated holding space 118 is reliably fitted (engaged) in the associated curved portion 114*a* of the fusion bonded part 114, so that the projection 133 is positioned in the holding space 118. Thus, the cleaning element 110 is reliably held by the holder body 130. Particularly, in the cleaning element holding state in which the cleaning element 110 is held by the holder body 130, the cleaning element 110 is prevented from moving in the longitudinal direction. Thus, such a construction is effective for preventing disengagement between the cleaning element 110 and the holder body 130. With such a construction, in addition to the inherent fusion bonding function, the fusion bonded parts 114 are provided with a further function of engaging with the projections 133 of the holder body 130. Thus, the holding structure of holding the cleaning element 110 can be simplified.

The fusion bonded parts 114 may have an appropriate shape such as a curved surface shape comprising a circular arc portion of a circle or an ellipse in part or in entirety, a curved surface shape formed by combination of a plurality of points, and a concave stepped shape.

As shown in FIG. 6, the central joining line 113 forms a fusion bonded portion that is designed to join the cleaning element body 111 and the holding sheet 112 in entirety in the thickness direction and is formed on the top and the back of cleaning element 110. On the other hand, the fusion bonded parts 114 and 117 are designed to join the fiber assembly 111*b* only in part in the thickness direction of the fiber assembly 111*b*. Further, the bonding thickness of the fusion bonded parts 117 in the thickness direction of the cleaning element body 111 (the fiber assembly 111*b*) is smaller than that of the fusion bonded parts 114.

With this construction, the fiber assembly 111*b* is classified into three kinds of fiber assembly parts by the fiber extending length between the fixed end and the right or left free end. The first fiber assembly part has a fiber extending length d3 extending from one end fixed at the central joining line 113 to the other free end (distal end) on the side opposite the fixed end or on the both sides of the fiber assembly 111*b*. The second fiber assembly part has a fiber extending length d4 (<fiber extending length d3) extending from one end fixed at the fusion bonded part 114 to the other free end on the both sides of the fiber assembly 111*b*. The third fiber assembly part has a fiber extending length d5 (<fiber extending length d4) extending from one end fixed at the fusion bonded part 117 to the other free end on the both sides of the fiber assembly 111*b*. In this case, the fiber assembly 111*b* has an upper layer portion formed by the fiber assembly parts having the fiber extending lengths d3, d4, d5, a middle layer portion formed by the fiber assembly parts having the fiber extending lengths d3, d4, and a lower layer portion formed only by the fiber assembly part having the fiber extending length d3.

With such a construction in which the fiber assembly 111*b* has the fiber assembly parts having different fiber extending lengths, when the cleaning element 110 is lightly shaken or loosened directly by user's hand such that air is taken into the fiber assembly 111*b*, the fiber assembly parts of the fiber assembly 111*b* which have a relatively long fiber extending length are easily entangled with each other and depend downward. On the other hand, the fiber assembly parts of the fiber assembly 111*b* which have a relatively short fiber extending length are not easily entangled with the downwardly depending fiber assembly parts. Therefore, when air is taken into the fiber assembly 111*b*, the fiber assembly 111*b* is held homogeneous with a limited amount of unnecessary voids, and the fiber assembly 111*b* is wholly densely spread. Thus the volume of the fiber assembly 111*b* is increased. This state in which the fibers have a high density and are homogeneous can be defined as providing a high voluminous feeling, and also referred to as a "bulky state", "volume increased state", "high space-fullness state" or "bulk-up state". In this embodiment, particularly with the construction in which the fiber assembly 111*b* is classified into three kinds of fiber assembly parts by the fiber extending length between the fixed end and the free end, increase in the number of kinds of the fiber assembly parts having different fiber extending lengths is effective in providing greater variations on the bulky state of the fiber assembly 111*b*.

Further, in this embodiment, with the construction in which the bonding thickness of the fusion bonded parts 117 is smaller than that of the fusion bonded parts 114, the fiber assembly parts having a relatively long fiber extending length increase in a proper balance toward the lower layer portion via the middle layer portion as viewed from the upper layer portion of the fiber assembly 111*b*. Thus, the entire fiber assembly 111*b* can be increased in volume in a proper balance. Therefore, the cleaning effect of the cleaning element 110 can be enhanced by increasing the volume of the fiber assembly 111*b* in a proper balance. Further, due to the volume increase, the fiber assembly 111*b* makes closer contact with a region to be cleaned. Therefore, dirt of the fiber assembly 111*b* stands out (the fiber assembly 111*b* is easily blackened), so that the user can get a higher level of satisfaction, realizing that dust is reliably trapped. Further, the fiber assembly 111*b* may also be constructed as necessary to have four kinds of fiber assembly parts having different extending lengths by using four or more kinds of fusion bonded parts having different bonding thicknesses in the thickness direction of the fiber assembly 111*b*.

Further, in this embodiment, the fusion bonded parts on the extending line L1 (the fusion bonded parts 114, 115) and the fusion bonded parts on the extending line L2 (the fusion bonded parts 117) may be out of alignment with respect to each other in the direction perpendicular to the longitudinal direction of the cleaning element 110 as shown in FIG. 4 (in the positional relationship of a first construction), or they may be in alignment with respect to each other in the direction perpendicular to the longitudinal direction of the cleaning element 110 (in the positional relationship of a second construction). In the case of the first construction, three kinds of the fiber assembly parts having different fiber extending lengths can be arranged in a proper balance in the longitudinal direction of the cleaning element 110. Thus, the volume of the fiber assembly 111*b* can be increased in a proper balance with a smaller number of fusion bonded parts. In the case of the second construction, three kinds of the fiber assembly parts having different fiber extending lengths can be concentrated on the positions in which the fusion bonded parts on the extending line L1 and the fusion bonded parts on the extending line L2 are in alignment with respect to each other.

Further, in this embodiment, each pair of the right and left fusion bonded parts 114, 115, 117 are formed on the both sides of the central joining line 113 at an equal distance therefrom and extend along the extending direction of the central joining line 113. Thus, the fiber assembly 111*b* can have a shape well-balanced between the right and left parts on the both sides of the central joining line 113. The bonded portion of the central joining line 113 may continuously linearly extend or discontinuously extend.

Further, in this embodiment, fibers joined to the base sheet 111*a* and the holding sheet 112 form a horizontal section having a relatively high bond strength between the central joining line 113 and the fusion bonded parts 114, 115, 117. This construction is effective in obtaining a high bond strength which cannot be obtained by joining only the base sheet 111*a* and the holding sheet 112. Further, with this construction in which the horizontal section is formed between the central joining line 113 and the fusion bonded parts 114, the cleaning element 110 can easily conform to a horizontal face to be cleaned, during cleaning operation. Thus, this construction is effective in enhancing the cleaning effect.

Figure 7:
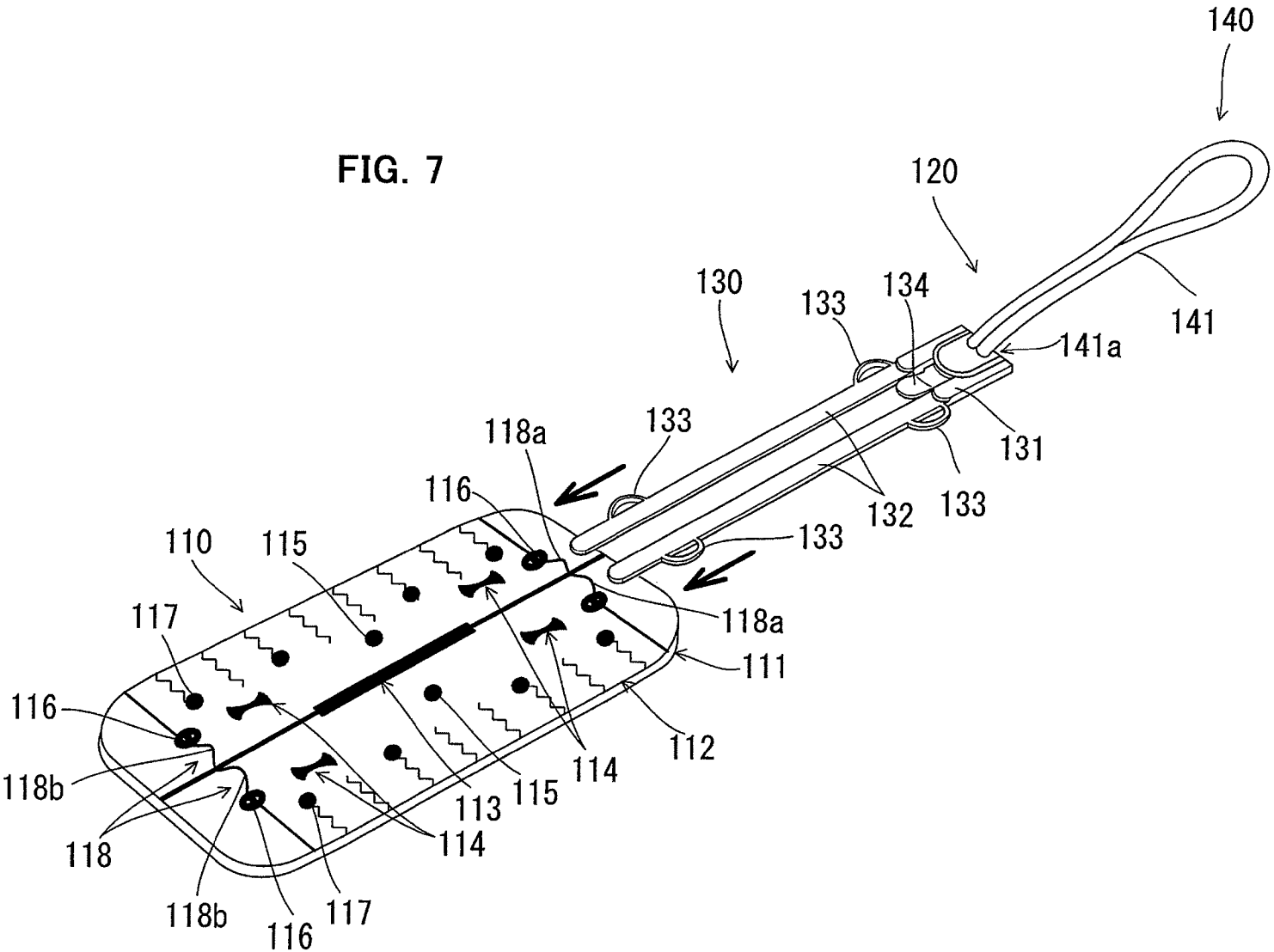
FIG. 7 is a perspective view showing the manner of attaching the cleaning element 110 to the cleaning element holder 120 in this embodiment.
Figure 8:
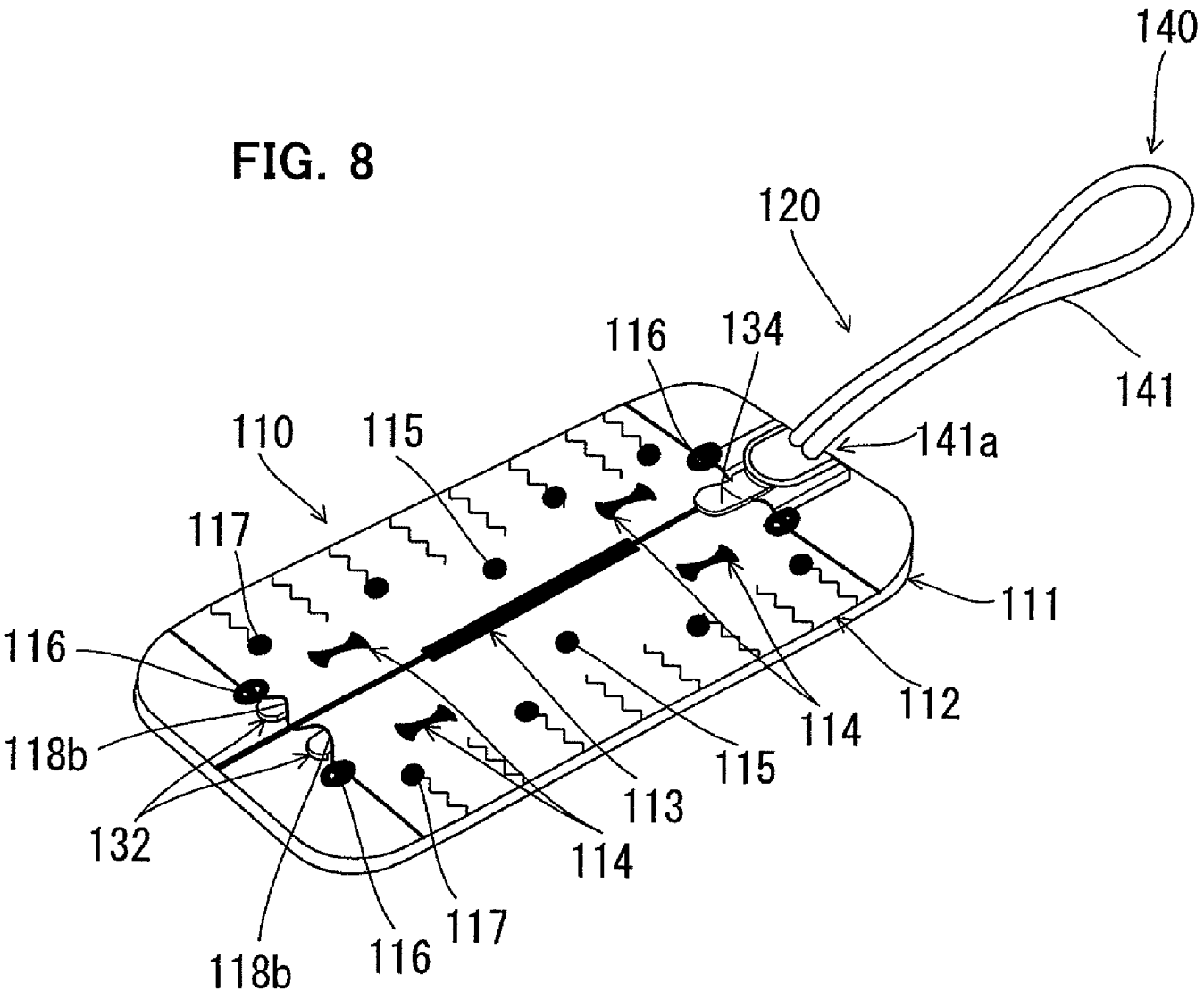
FIG. 8 is a perspective view showing the manner of attaching the cleaning element 110 to the cleaning element holder 120 in this embodiment.
Figure 9:
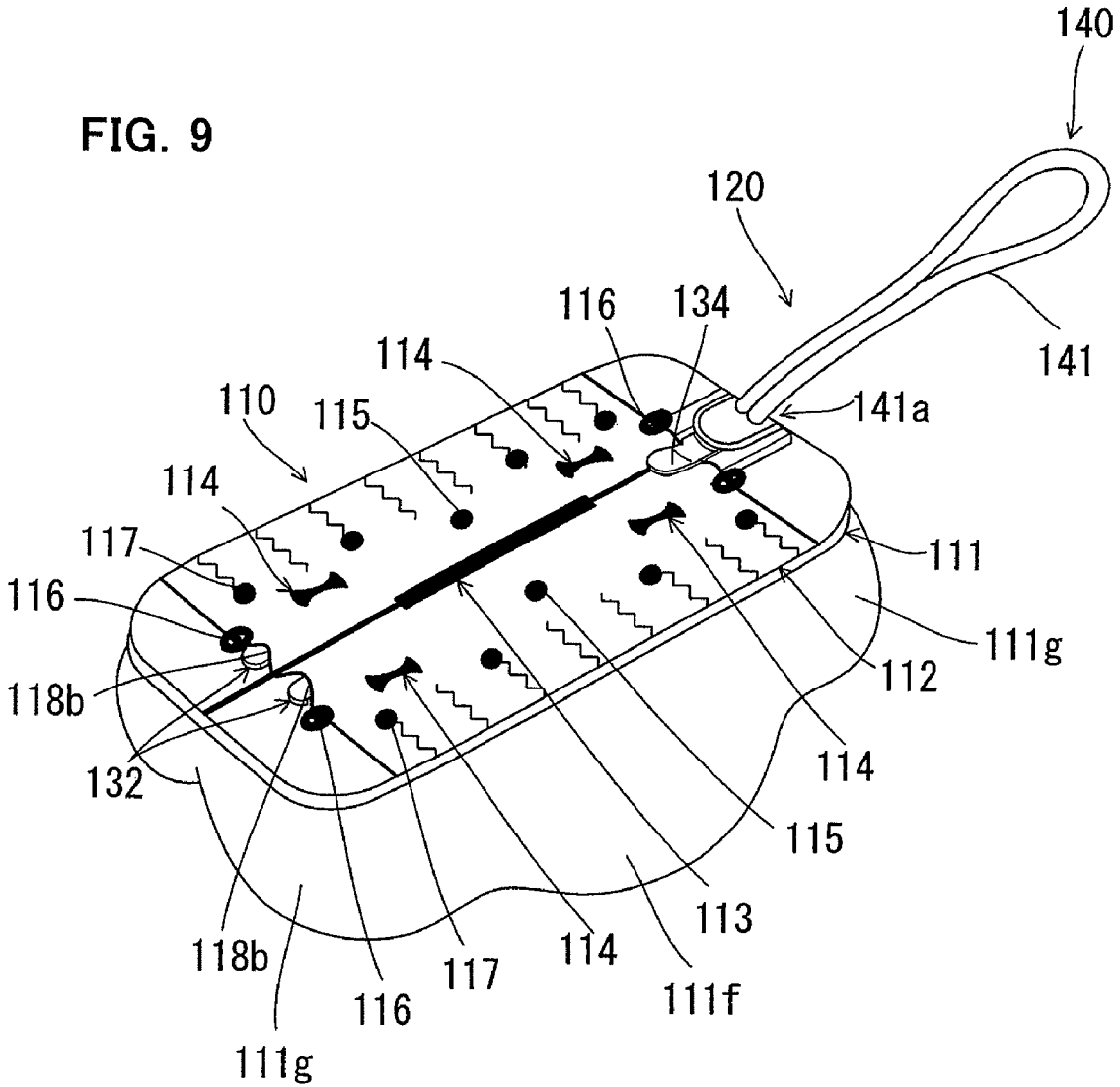
FIG. 9 is a perspective view of the cleaning tool 100 shown in FIG. 8, showing the cleaning element 110 in the loosened state.

Usage of the cleaning tool 100 having the above-described construction is now described with reference to FIGS. 7 to 9. FIGS. 7 and 8 are perspective views showing the manner of attaching the cleaning element 110 to the cleaning element holder 120 in this embodiment. FIG. 9 is a perspective view of the cleaning tool 100 shown in FIG. 8, showing the cleaning element 110 in the loosened state.

In order to use the cleaning tool 100, as shown in FIG. 7, each of the holding plates 132 of the holder body 130 is inserted from the associated rear open end 118*a* of the holding space 118, so that the cleaning element 110 is attached to the cleaning element holder 120. With the construction of this embodiment in which the holding space 118 has the rear open end 118*a* and the front open end 118*b*, the holding plate 132 of the holder body 130 can be inserted from the front open end 118*b* of the holding space 118, as necessary, so that the cleaning element 110 can also be attached to the cleaning element holder 120 in the inverted position.

Specifically, first, the front ends of the holding plates 132 are inserted into the holding space 118. At this time, the front projection 133 of each of the holding plates 132 is engaged with the inner edge portion of the fusion bonded part 116. Thus, the holding plate 132 is positioned with respect to the holding space 118. In this embodiment, the fusion bonded part 116 has components extending in the longitudinal direction. Therefore, the direction of movement of the holding plate 132 can be naturally fixed on a line even if the user does not care about it, and the holding plate 132 can be smoothly guided forward in the holding space 118. The holding plate 132 is inserted into the holding space 118 while the holding plate 132 itself and the projection 133 having the hollow portion 133*a* repeat inward deformation and reversion (recovery). Thus, the projection 133 is fitted (engaged) in the associated curved portion 114*a* of the fusion bonded part 114. Further, if such deformation of the holding plate 132 is realized by deformation of the holding plate 132 itself or deformation of materials forming the cleaning element 110, the projection 133 may have a solid structure instead of a hollow structure.

When the front and rear projections 133 are received in the associated curved portions 114*a*, the base 131 of the holder body 130 interferes with the rear open end 118*a*, so that the holder body 130 is prevented from further moving forward. In this state, the cleaning element holder 120 is attached to the cleaning element 110. Further, in this attached state, the cleaning element 110 is prevented from moving in the longitudinal direction by engagement between the projections 133 and the curved portions 114*a*. Thus, the cleaning element 110 is prevented from coming off the cleaning element holder 120 just by lightly shaking the cleaning element holder 120.

In this manner, the cleaning tool 100 is provided in the state shown in FIG. 8. In this state, the thickness of the cleaning element 110 is kept to a minimum. Further, the cleaning side sheet 111*c* facing the face to be cleaned is held separated from the fiber assembly 111*b*, so that it cannot perform a desired cleaning function. In order to obtain a desired cleaning function, preferably, the cleaning element 110 shown in FIG. 8 is lightly shaken or loosened directly by hand, or lightly shaken with the cleaning element holder 120 held by hand, such that air is taken into the fiber assembly 111*b* and the fiber assembly 111*b* expands three-dimensionally.

By thus loosening the cleaning element 110, the fibers of the fiber assembly 111*b* are mixed with the strips 111*e* of the cleaning side sheet 111*c*. Upon swinging movement of the strips 111*e* about the fixed ends in the form of the central fusion-bonding line 113 or the fusion bonded parts 114, 115, 117, the outer free ends of the strips 111*e* depend downward under the own weight. At this time, the fibers of the fiber assembly 111*b* depend downward together with the strips 111*e* of the cleaning side sheet 111*c*. Thus, containing air in the fiber bundle 111*b*, the cleaning element 110 is made bulkier than before the cleaning element holder 120 is attached. Specifically, in synchronization with the swinging movement of the strips 111*e* of the cleaning side sheet 111*c*, the cleaning element 110 expands by containing air between the fibers of the fiber assembly 111*b*.

Particularly, in this embodiment, the strips 111*e* of the cleaning side sheet 111*c* have a relatively smaller width than the strips 111*d* of the base sheet 111*a*. Therefore, the volume of the fiber assembly 111*b* can be increased without causing a problem that the strips 111*e* impair elasticity of the fiber assembly 111*b*. Thus, the users can gain higher expectations and peace of mind with respect to the dust trapping function. Further, by forming the fiber assembly 111*b* by using crimped fibers as mentioned above, the fibers of the fiber assembly 111*b* can be easily entangled with the strips 111*e* of the cleaning side sheet 111*c*.

Thus, as shown in FIG. 9, the fibers of the fiber assembly 111*b* are mixed with the strips 111*e* of the cleaning side sheet 111*c* and the fiber assembly 111*b* is increased in volume, so that the cleaning element 110 expands three-dimensionally. At this time, a main cleaning part 111*f* is formed in the central region of the cleaning element 110, and auxiliary cleaning parts 111*g* are formed in the front and the rear of the cleaning element 110. The main cleaning part 111*f* of the cleaning element 110 serves as a main cleaning part for trapping dust, and the auxiliary cleaning parts 111*g* serve to assist the function of the main cleaning part 111*f*.

In this embodiment, by expansion of the main cleaning part 111*f* of the cleaning element 110, the main cleaning part 111*f* can more easily conform to (or make close contact with) irregular or curved surfaces of the face to be cleaned. At this time, the fibers of the fiber assembly 111*b* which are mixed with the strips 111*e* of the cleaning side sheet 111*c* perform a cleaning function in cooperation with the strips 111*e*. Particularly, the fiber assembly 111*b* serves as a core of a dirt collecting function as dirt is entangled between the fibers of the fiber assembly 111*b* or on the crimped portions of the fibers. Further, the fiber assembly 111*b* is exposed downward from the strips 111*e* and thus appears to be increased in volume, which can provide the users with higher expectations and peace of mind with respect to the dust trapping function. The strips 111*e* have a dirt collecting function as a supplement to the fiber assembly 111*b* serving as a core of the dirt collecting function. The strips 111*e* can easily reach into finer irregularities or curved surfaces of the object to be cleaned and retain the dust between the strips or on the strip faces, thus performing a cleaning function. The strips 111*d* of the base sheet 111*a* and the strips 112*a* of the holding sheet 112 are not easily affected by the movement of the fiber assembly 111*b* and perform a dust wiping-out function independently of the movement of the fiber assembly 111*b*.

The present invention is not limited to the embodiment as described above, but rather, may be added to, changed, replaced with alternatives or otherwise modified. For example, the following provisions can be made in application of this embodiment.

In the above-described embodiment, the cleaning element 110 is described as including the base sheet 111*a*, the fiber assembly 111*b* and the holding sheet 112. However, in this invention, it is essential for the cleaning element 110 to include at least the base sheet and the holding sheet. Therefore, the cleaning element 110 may be constructed such that the fiber assembly 111*b* is omitted and the base sheet 111*a* has a main cleaning function in place of the fiber assembly 111*b*, or it may be formed only from the base sheet 111*a* and the holding sheet 112.

Further, in this embodiment, the cleaning element 110 is described as having the central joining line 113 and the fusion bonded parts 114, 115, 116, 117. However, in this invention, it is essential for the cleaning element 110 to have at least the fusion bonded part having the concave portion facing the holding space, such as the fusion bonded part 114. Therefore, the fusion bonded parts other than the fusion bonded parts 114 can be omitted as necessary. Further, depending on the product specifications, the fusion bonded parts 114 may be arranged at the rear open end 118*a* and the front open end 118*b* and the fusion bonded parts 116 can be omitted. In this case, the fusion bonded parts 114 can also efficiently serve as equivalents to the fusion bonded parts 116.

Further, although, in this embodiment, each of the fusion bonded parts 114 is described as having the curved portion 114*a* as shown in FIG. 4, it is essential for the fusion bonded part 114 to have a concave portion at least on the side of the central joining line 113. The shape and the number of the fusion bonded part 114 having the curved portion 114*a* can be changed as necessary. For example, the fusion bonded part 114 having the curved portion 114*a* may be arranged either on the right or left fusion bonded parts, or may be arranged in a position displaced in the longitudinal direction of the cleaning element 110 with respect to the right or left fusion bonded parts.

Further, although, in this embodiment, the two holding plates 132 of the cleaning element holder 120 are described as being inserted into the two holding spaces 118 of the cleaning element 110, the numbers of the holding spaces and the cleaning element holding portions are not limited and can be changed as necessary. For example, one holding space may be provided in the cleaning element and one holding plate may be provided on the cleaning element holder such that the holding plate can be inserted into the holding space.

Description of Numerals

100 cleaning tool
110 cleaning element
111 cleaning element body
111*a* base sheet
111*b* fiber assembly
111*c* cleaning side sheet
111*d*, 111*e* strip
111*f* main cleaning part
111*g* auxiliary cleaning part
112 holding sheet
112*a* strip
113 central joining line
114, 115, 116, 117 fusion bonded part
118 holding space
118*a* rear open end
118*b* front open end
120 cleaning element holder
130 holder body
131 base
132 holding plate
133 projection
133*a* hollow portion
134 retaining plate
140 handle
141 handle body
141*a* connection

What we claim is:

1. A cleaning element comprising:

a base sheet and a holding sheet which are formed of sheet-type nonwoven fabric, a first group and a second group of a plurality of fusion bonded parts which are discontinuously formed along a predetermined direction to fusion bond the base sheet and the holding sheet overlaid to each other, a holding space demarcated by the first group of the plurality of the fusion bonded parts and the second group of the plurality of the fusion bonded parts between the base sheet and the holding sheet, the holding space having an open end at least on either one side of the both ends of the cleaning element in the predetermined direction, at least one of first and second groups of the fusion bonded parts includes a fusion bonded part having a concave portion facing the holding space, wherein the concave portion engages with an attachment that is attached to the holding space.

2. The cleaning element as defined in claim 1, further comprising a fiber assembly overlaid on one face of the base sheet having the other face on which the holding sheet is overlaid, the fiber assembly comprising a plurality of fibers and a second fusion bonded part provided between the first group of the plurality of the fusion bonded part and the second group of the plurality of the fusion bonded part and extending in the predetermined direction so as to fusion bond the base sheet and the fiber assembly, the second fusion bonded part demarcating the holding space into two space portions.

3. The cleaning element as defined in claim 2, wherein the first group and the second group of a plurality of fusion bonded parts and the second fusion bonded part fusion bond the base sheet and the fiber assembly to each other.

4. The cleaning element as defined in claim 1, wherein the holding space is provided as a region to which a cleaning element holding portion of a holder is inserted.

5. A cleaning tool comprising the cleaning element as defined in claim 1 and a cleaning element holder, the cleaning element holder being removably attached to the cleaning element, wherein:

the cleaning element holder includes a grip to be held by a user in a cleaning operation, a cleaning element holding portion that is coupled to the grip, extends elongate and is inserted into the holding space of the cleaning element, thereby holding the cleaning element, and a projection that projects outward from the cleaning element holding portion, and when the cleaning element holding portion is inserted into the holding space, the projection engages with the concave portion such that relative movement of the cleaning element holding portion with respect to the cleaning element in the predetermined direction is prevented.

* * * * *